US005566996A

United States Patent [19]

Massey et al.

[11] Patent Number: 5,566,996

[45] Date of Patent: Oct. 22, 1996

[54] METHOD AND APPARATUS FOR ATTACHMENT OF A DOOR LOCK TRIM ROSE

[75] Inventors: William S. Massey, Yoder; Rocco A. Carestia, Colorado Springs, both of Colo.

[73] Assignee: Schlage Lock Company, San Francisco, Calif.

[21] Appl. No.: 431,161

[22] Filed: Apr. 28, 1995

[51] Int. Cl.[6] ..... E05B 15/02

[52] U.S. Cl. ..... 292/357; 292/356

[58] Field of Search ..... 292/357, 356

[56] References Cited

U.S. PATENT DOCUMENTS

| | | | |
|---|---|---|---|
| 2,759,754 | 8/1956 | Kaiser | 292/357 X |
| 4,869,083 | 9/1989 | DeMarseilles et al. | 292/357 X |
| 5,149,155 | 9/1992 | Caeti et al. | 292/357 X |

FOREIGN PATENT DOCUMENTS

| | | | |
|---|---|---|---|
| 810553 | 4/1969 | Canada | 292/357 |
| 484594 | 5/1992 | European Pat. Off. | 292/357 |

*Primary Examiner*—Rodney M. Lindsey
*Attorney, Agent, or Firm*—Robert F. Palermo

[57] ABSTRACT

A system for attaching door lock trim roses on inside and outside faces of a door, has a mounting chassis with inside and outside members, each having outwardly projecting portions with opposed cylindrical sector arcs. Fasteners join the outside member to the inside member to secure both members against the outside and inside faces of the door. Interchangeable hollow inside and outside trim roses have at least two inwardly projecting pips close to a door contacting lip of the trim rose. Detents on the outside member of the mounting chassis receive the pips of the outside trim rose and secure the outside trim rose against the outside face of the door; and grooves on the inside member of the mounting chassis receive the pips of the inside trim rose. Grooves consist of at least two undercut sites on the periphery of a cylindrical portion of the inside member and extend axially from a face of the inside member in contact with the inside face of the door a maximum distance at a first end and a minimum distance at a second end, the undercut sites acting as portions of a screw thread in which the pips of the trim rose are engaged for fastening the trim rose.

4 Claims, 3 Drawing Sheets

METHOD AND APPARATUS FOR ATTACHMENT OF A DOOR LOCK TRIM ROSE

BACKGROUND OF THE INVENTION

This invention relates generally to installation of door hardware and door hardware trim and more particularly to an attachment method and apparatus for door trim roses designed to improve fit and rattle resistance and to simplify installation of the hardware.

Most door locks have trim roses, surrounding the spindle of the knob or lever, which conceal the inner mounting hardware and give the mounted lock a finished appearance. These are commonly fastened to the door by screws, spring clips and slots, or some combination thereof. Usually, the outside rose is attached by hidden and tamperproof means, while the inside rose attachment is both visible and accessible. This is not normally objectionable since rose attachment devices are not usually unduly obtrusive. However, by their design which provides near invisibility, the strength of attachment is often compromised in such a way as to allow a gap between the door and the rose to form, detracting from the appearance and permitting rattling of the rose against the door. Although fastening with screws can usually prevent such deterioration, many people object to the relatively high visibility of threaded fasteners. Thus, function often must be compromised for the sake of appearance.

Another difficulty associated with door hardware installation is assuring snug attachment of the latch housing and spindle in the door preparation. Frequently, a door latch is installed and seems to be working well, but after a short time in operation, the fasteners work loose and the spindle begins to wobble and sag. This is usually due to the difficulty in locking the fasteners in their properly tightened positions. The result is a sloppy operating feeling and accelerated wear of the assembly.

The foregoing illustrates limitations known to exist in present rose attachment systems for door hardware. Thus, it would clearly be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by a system for attaching door lock trim roses on inside and outside faces of a door, including a mounting chassis having an inside member, an outside member, and means for joining the inside member to the outside member to secure the members against the inside and outside faces of the door; a hollow inside trim rose and a hollow outside trim rose, each trim rose having at least two inwardly projecting pips in close proximity to an edge of the trim rose which edge contacts a face of the door after installation of the trim rose; detent means on the outside member of the mounting chassis for receiving the pips of the outside trim rose and for thereby securing the outside trim rose against the outside face of the door; and a groove arrangement on the inside member of the mounting chassis for receiving the pips of the inside trim rose, the groove arrangement including at least two undercut sectors which are opposedly spaced on opposedly spaced arcs on the periphery of a projecting portion of the inside member, undercut to a depth less than the radial extent of said pips of said inside trim rose, adjacent an edge of the inside member which is in contact with the face of the door when mounted thereon, to capture the pips and to maintain the rose elastically biased against said door when the rose is installed.

The foregoing and other aspects will become apparent from the following detailed description of the invention when considered in conjunction with the accompanying drawings.

DETAILED DESCRIPTION

Figure 1A:
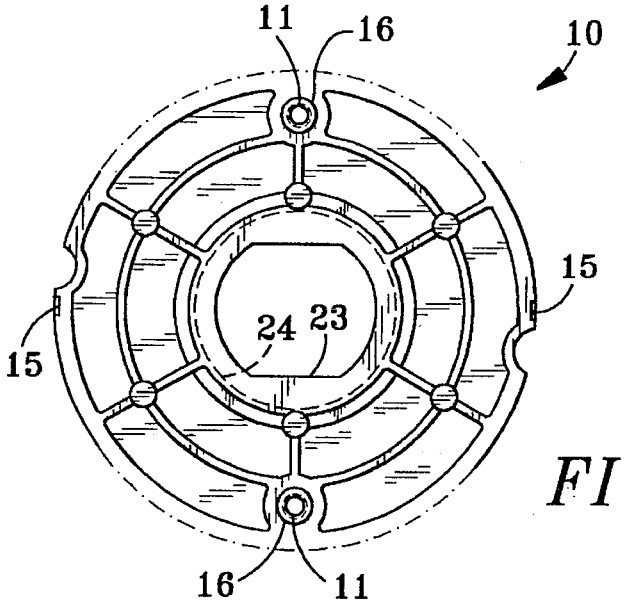
FIGS 1*a*, 1*b*, and 1*c* are schematic plan views, looking outward from the door face, of outside and inside mounting chassis members and a trim rose, respectively, showing key features of the invention.
Figure 1B:
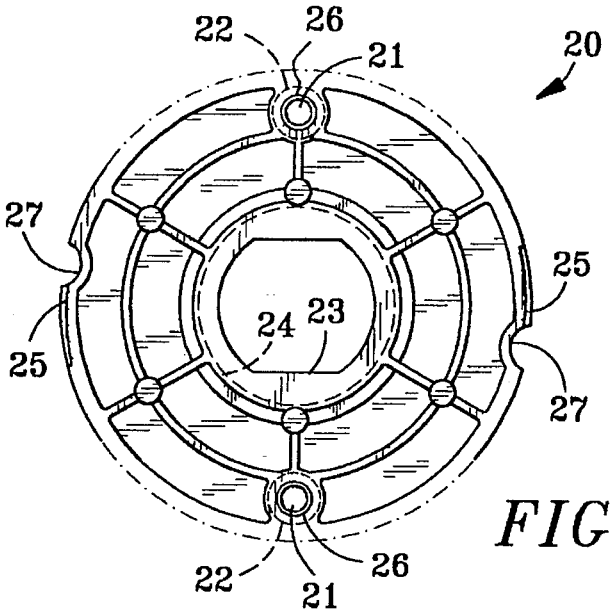
Figure 1C:
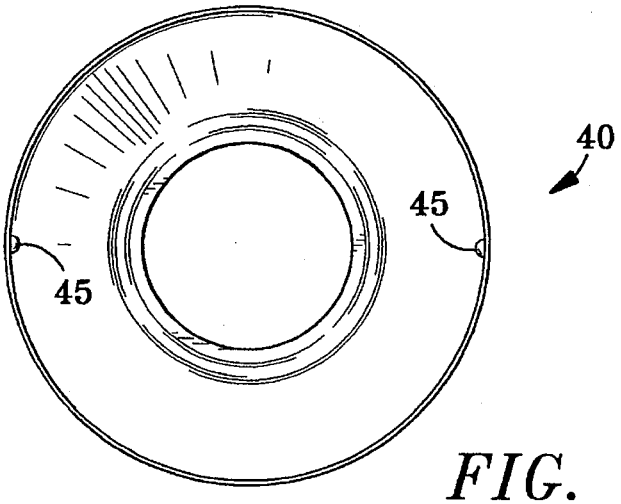

FIGS. 1*a* and 1*b* show the outside and inside members, respectively, of the mounting chassis of the present invention. In this view which is looking outward from the door face, a number of ribs are visible. These are only one possible arrangement and are primarily intended to save material without sacrificing strength or causing distortion during molding. The members are shown as circular; because that is the preferred shape. However, it will be readily understood that a triangular, square, or even a rounded elongated shape may be used, so long as the periphery of the member provides at least two symmetrically spaced cylindrical arc sectors for providing a balanced grip on the rose trim ring. For example, in the case of an elongated rose, it would require at least one end with opposed and suitably shaped mounting provisions and a stop to prevent sliding. The dotted portions of the members are intended to represent generalized shapes to be selected as appropriate to the application.

It is probably best to describe the invention in its preferred embodiment by referring to FIGS. 1*a* through 4*b*, inclusively, in order to provide the necessary clarity and detail without undue repetition. In discussing the Figures, any features which are identical on the various components are numbered the same, so that it should be understood that different numbers refer to features which are actually different. Of course, not all features of a given component are visible in every view. Accordingly, a feature occasionally will be referred to by number in describing a Figure, and that feature may not be visible (or numbered) on that Figure. In such cases, the feature is numbered on the Figure in which it is visible, and a reference to the appropriate Figure is understood.

The outside member 10 and the inside member 20, in FIGS. 1*a* and 1*b* each have at least two symmetrically spaced undercut features on their outer peripheries for mounting trim roses 40. On the outside member 10, these are detents 15 at the face 19 of the member (backside face) which contacts the door face when installed on the door. They are deep enough to firmly hold the rose trim ring 40 when the pips 45 are engaged therewith. The inside member 20 has grooves 25 abutting its back face 29 and opposedly arranged as shown. The grooves 25 are open to entry slots 27 which permit unimpeded passage of pips 45 during placement of the trim ring 40 and entry of the pips into the undercut portions of the grooves.

Outside member 10 has mounting legs 16 with holes 11 and threads 12 to engage threaded fasteners (not shown) which protrude from unthreaded holes 21 in the mounting legs 26 of inside member 20 and to thereby hold both members against the door. Inside member 20 also has recesses 22 to accommodate fastener heads without interfering with installation of trim rose 40.

The detents of outside member 10 are deep enough at flats 15*b* to firmly hold the rose trim ring 40 when the pips 45 are engaged therewith, and they each have a planar bevel 15*a* extending axially from flats 15*b* away from face 19 to intersect with the periphery of the member. The radial depth of detent 15 at flat 15*b* is equal to the radial extent of pips 45 less a small amount in order to maintain the rose 40 under a slight elastic radial stress to prevent rattling. Bevels 15*a* are located such that the pips 45 rest on them when rose 40 is installed. This causes an additional elastic radial stress which, because of the bevel angle, acts on the rose 40 to bias it toward the door (not shown) so that its skirt 49, which extends at least as far as faces 19, 29 of inside and outside members 10, 20, is held in firm contact with the door when the rose 40 is installed on outside member 10 of the mounting chassis. Installation is accomplished by aligning the pips 45 with detents 15 and pushing the rose 40 toward the door until it snaps in place. During mounting, the tapered or beveled outer face (not numbered) of inside 20 and outside 10 members acts as an inclined plane for stretching the rose until the pips 45 can snap into detents 15.

The grooves 25 of inside member 20 of the mounting chassis extend along its periphery adjacent face 29 of the member. Together with slots 27, the grooves provide an easy installation feature for the rose 40. Pips 45 are simply lined-up with slots 27, and the rose 40 is placed against the door. When the rose 40 is turned slightly in the clockwise direction it brings pips 45 into engagement with grooves 25 and thereby secures the rose 40 against the face of the door.

Figure 2C:
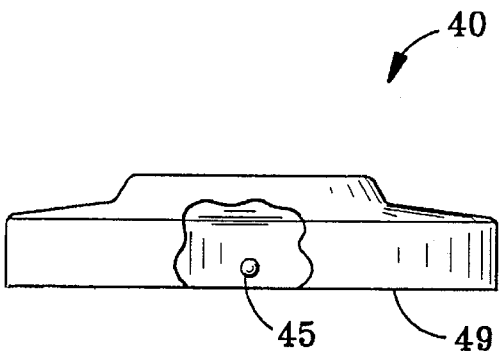
FIGS. 2*a*, 2*b*, and 2*c* are schematic side elevation views of the components illustrated in FIG. 1 showing slots, grooves, and undercuts on the outside and inside members, and pips on the trim rose to illustrate novel features of the invention.
Figure 2B:
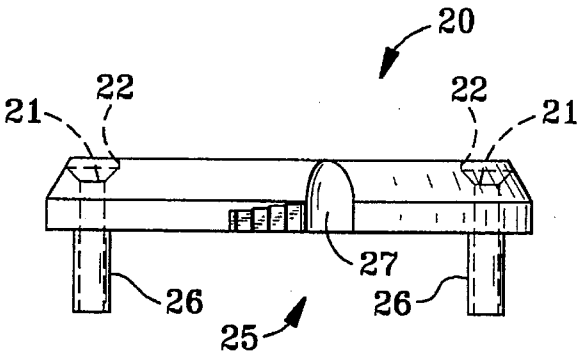
Figure 2A:
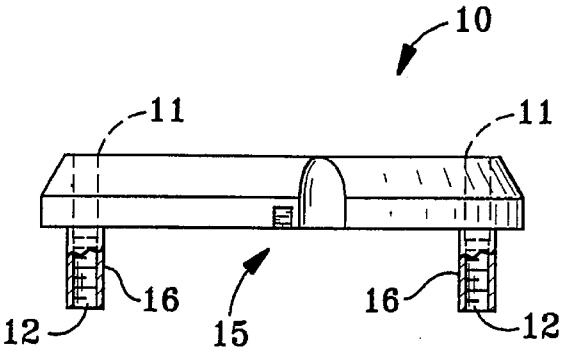
Figure 3C:
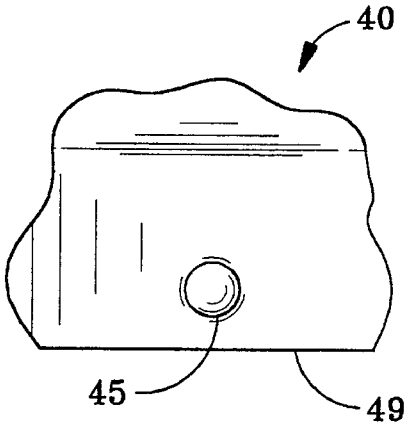
FIGS. 3*a*, 3*b*, and 3*c* are fragmentary elevation views of the inside and outside members and the trim rose of the invention showing further details of the grooves, undercuts, and pips illustrated in FIGS. 1 and 2.
Figure 3B:
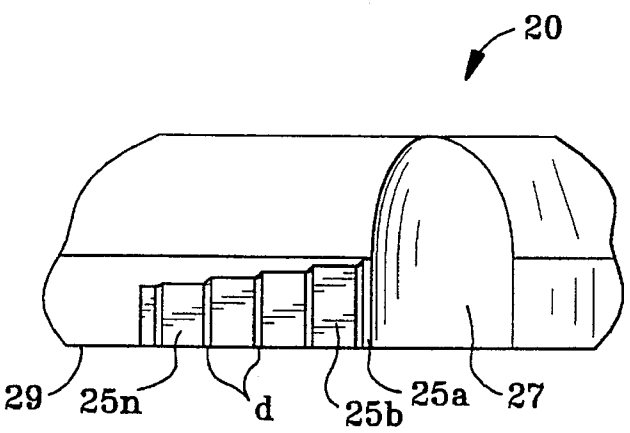
Figure 3A:
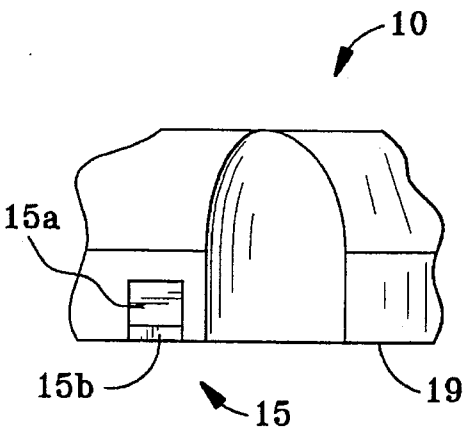
Figure 4A:
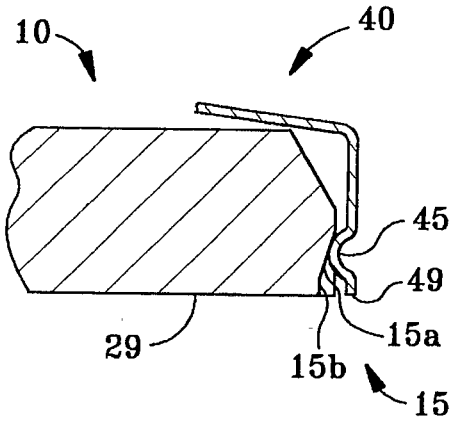
FIGS. 4*a* and 4*b* are fragmentary sectional views illustrating trim roses mounted on outside and inside members.
Figure 4B:
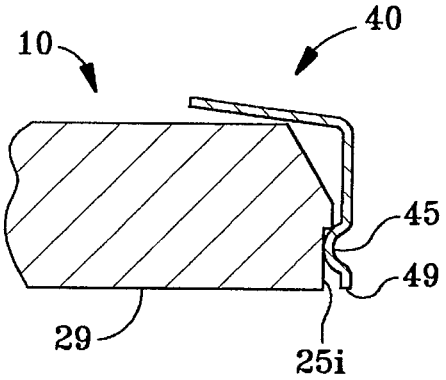

The view in FIGS. 2*b* and 3*b* show additional detail of grooves 25. Notice that, at a first end adjacent slot 27, the axial extent of the groove 25*a* is a maximum, 25*b* is slightly less (approximately 0.005" to 0.020"), and so on until 25*n* is n-times slightly less than 25*a*. This imparts a screw thread effect to the grooves 25 such that the trim rose 40 is held increasingly tightly against the door as the rose is turned to a more clockwise position on the inside member 20. Between each pair of segments (25*a*–25*n*) of the groove 25 is a detent "d" which assures that the rose 40 will not loosen due to vibration or minor bumping, once it is installed. The edge of the groove 25 which is away from face 29 of inside member 20 is stepped as previously described from a maximum height at 25*a* to a minimum height at 25*n*, and a taper or bevel is provided at each detent "d" to provide easy travel, in either direction, of pip 45 along the edge of groove 25 from one groove segment 25*i* to the next groove segment 25($i$+1).

These bevels are necessary for repeated installation and removal of rose 40; because the substantially hemispherical shape of pips 45 makes it very difficult to force the pips 45 past sharp corners. Even with the planar bevel 15*a* of detent 15 of outside member 10, it is very difficult to remove rose 40, after it is installed, due to the high strength of rose 40 and the strong elastic radial grip which it exerts on the outside member 10. In the same way, the sharp stepped edge of groove 25 holds the pips 45 of rose 40 so securely that removal without counterclockwise rotation to align the pips 45 with slots 27 is virtually impossible without damaging something. These features are readily seen by comparing FIGS. 2*a–c*, 3*a–c*, and 4*a–b*.

Figure 5A:
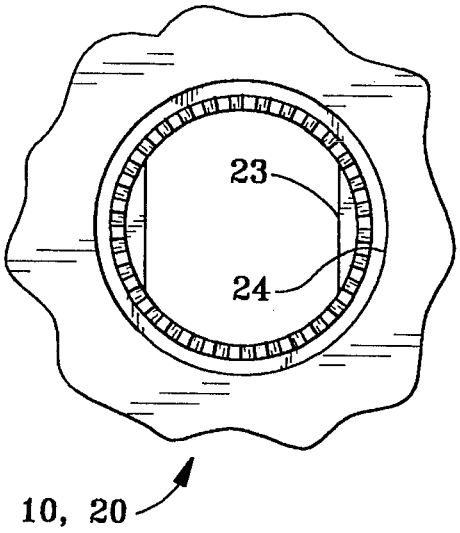
FIGS. 5*a* and 5*b* are fragmentary plan and elevation views illustrating a nut locking feature of the inside and outside members of the mounting chassis.
Figure 5B:
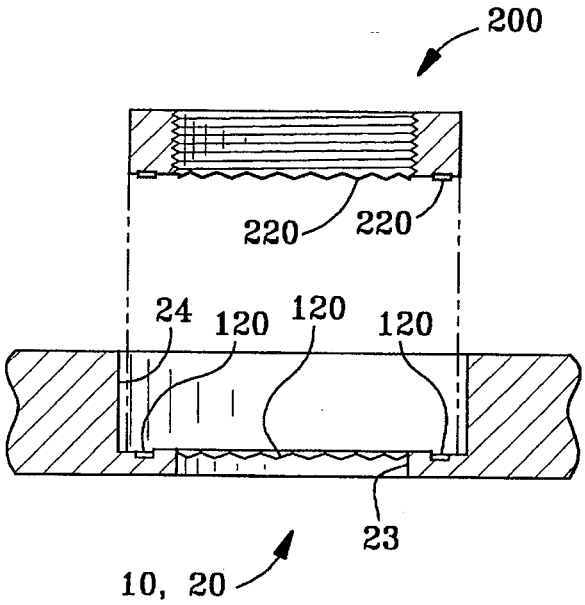

FIGS. 5*a* and 5*b* show a nut-lock feature incorporated in inside member 20 and outside member 10 for preventing unintended loosening of spindle nuts 200 which are used to center and secure the latchbolt and spindle within the door. In the illustrated embodiment, nut 200 has rippled or knurled ring 220 on its gripping face (the face which contacts the inside/outside member 20, 10. The member has a mating rippled ring 120 within a bore 24 and surrounding a flat sided hole 23 in the member. This hole provides orientation between the spindles, the inside and outside members 20, 10, and the roses 40. When the member 20, 10 is placed over the flat sided and externally threaded spindle housing and installed in the door, nuts 200 are threaded on the spindle housing and, by balancing between the outside member 10 and inside member 20 using the threaded nuts; the latch and spindles are centered in the door, and the nuts are then tightened. Rippled ring 220 of nut 200 interferes with rippled ring 120 of member 10, 20 as their faces come in contact with each other, and they lock together to resist loosening of the nuts 220 on the spindle housings except when intentionally loosened with a wrench.

What is claimed is:

1. A system for attaching door lock trim roses on inside and outside faces of a door, comprising:

a mounting chassis comprising an outside member and an inside member, said members each having two opposed cylindrical arc portions together with means for joining said outside member to said inside member to secure said mounting chassis to the door with both members firmly positioned against the outside and inside faces, respectively, of said door;

a hollow inside trim rose and an outside trim rose interchangeable therewith, both trim roses having same means of attachment to said mounting chassis, each said trim rose having two diametrically opposed pips projecting radially inwardly to a given radial extent, said pips lying in close proximity to an edge of said trim rose which contacts a face of said door after installation of said trim rose thereon;

detent means on said outside member of said mounting chassis for receiving the pips of said outside trim rose and for thereby securing said outside trim rose against the outside face of said door; and groove means on said inside member of said mounting chassis for receiving the pips of the inside trim rose, said groove means comprising at least two undercut sites, opposedly spaced on opposedly spaced cylindrical sector arcs on the periphery of a projecting portion of the inside member, undercut to a depth less than the radial extent of said pips of said inside trim rose, adjacent an edge of the inside member which is in contact with the face of the door when mounted thereon, to capture the pips and to maintain the rose against said inside face of said door and under a constant elastic stress when said rose is installed on said mounting chassis.

2. The system of claim 1, wherein each of the undercut sites extends along a peripheral surface of said inside member and has a maximum axial extent at a first end and a minimum axial extent at a second end, measured from a face of said inside member in contact with the inside face of said door, said undercut sites serving as portions of a screw thread in which the pips of the trim rose are engaged to fasten said trim rose to said outside member and to increase contact force between said trim rose and said door face.

3. The system of claim 2, further comprising:

an access slot means, adjacent the first end of each of the undercut sites, for providing a free path of engagement between the pips and the undercut sites.

4. A method for attaching door lock trim roses on inside and outside faces of a door, comprising the following steps:

installing a mounting chassis comprising inside and outside members and joining said inside and outside members together to secure said members against the inside and outside faces of said door, respectively;

selecting hollow inside and outside trim roses, said roses being interchangeable, both trim roses having the same means of attachment to said mounting chassis, each said rose having a peripheral skirt for covering outwardly projecting portions of said inside and outside members and at least two radially inwardly projecting pips opposedly spaced on the periphery of said skirt in close proximity to an edge which contacts a face of said door after installation of said trim rose;

aligning the pips of the outside trim rose with detent means on the outside member of said mounting chassis, and pushing the rose axially onto saidoutside member until the pips of said rose snap into the detent means of said outside member and thereby secure said outside trim rose against the outside face of said door;

aligning the pips of the inside trim rose with slots which provide access to groove means on the inside member of said mounting chassis for receiving the pips of the inside trim rose, said groove means comprising at least two undercut sites, said undercut sites being opposedly arrayed on opposed cylindrical sector portions of said inside member and extending axially from a face thereof, in contact with the inside face of said door, a maximum distance at a first end, adjacent said slot, and a minimum distance at a second end, away from said slot, said undercut sites functioning as portions of a thread in which the pips of the trim rose are engaged for holding said trim rose; and rotating said inside trim rose to cause the pips to move toward the second ends of said opposed undercut sectors until said rose is firmly seated against the door face.

* * * * *